United States Patent [19]

Takahashi et al.

[11] Patent Number: 4,838,480

[45] Date of Patent: Jun. 13, 1989

[54] DEVICE FOR ACCOMODATING CASH ENCLOSING ENVELOPES

[75] Inventors: Kiyotaka Takahashi, Muko; Kathuhiko Arimoto, Omihachiman, both of Japan

[73] Assignee: Omron Tateisi Electronics Co., Kyoto, Japan

[21] Appl. No.: 82,997

[22] Filed: Aug. 7, 1987

Related U.S. Application Data

[63] Continuation of Ser. No. 738,415, May 28, 1985, abandoned.

[30] Foreign Application Priority Data

May 31, 1984 [JP] Japan ..... 59-112764

[51] Int. Cl.[4] ..... B65D 91/00

[52] U.S. Cl. ..... 232/43.3; 109/24.1; 271/217; 271/219

[58] Field of Search ..... 232/10, 43.1, 43.2, 232/43.3; 271/214, 215, 217, 2, 219; 109/24.1

[56] References Cited

U.S. PATENT DOCUMENTS

| | | | |
|---|---|---|---|
| 2,849,236 | 8/1958 | Beaulieu | 271/215 |
| 2,853,725 | 9/1958 | Schoenberger, Jr. | 198/627 |
| 2,923,587 | 2/1960 | Zipf | 232/1. D |
| 3,101,892 | 8/1963 | Reese, Jr. | 232/43.3 |
| 3,102,627 | 9/1963 | Acton et al. | 198/456 |
| 3,182,994 | 5/1965 | Huth | 271/240 |
| 3,213,733 | 10/1965 | Glendening | 198/836 |
| 3,237,365 | 3/1966 | Koulakoff et al. | 198/836 |
| 3,334,895 | 8/1967 | Daniels et al. | 271/215 |
| 3,540,970 | 11/1970 | Huntwork | 156/364 |
| 3,772,971 | 11/1973 | Dutro et al. | 271/217 |
| 3,779,367 | 12/1973 | Hope et al. | 198/628 |
| 3,800,679 | 3/1982 | Bartelheimer | 156/363 |
| 3,873,443 | 3/1975 | Cothran et al. | 209/111.7 |
| 3,968,364 | 7/1976 | Miller | 271/215 |
| 4,016,980 | 4/1977 | DeHart et al. | 209/111.7 T |
| 4,085,687 | 4/1978 | Beck et al. | 109/24.1 |
| 4,228,994 | 10/1980 | Volpe | 271/250 |
| 4,229,650 | 10/1980 | Takahashi et al. | 271/215 |
| 4,230,218 | 10/1980 | Kunzmann | 198/622 |
| 4,308,804 | 1/1982 | Guibord et al. | 109/24.1 |
| 4,310,160 | 1/1982 | Willette et al. | 271/219 |
| 4,312,277 | 1/1982 | Graef et al. | 109/24.1 |
| 4,314,869 | 2/1982 | Crankshaw | 156/364 |
| 4,321,103 | 3/1982 | Lindstrom et al. | 156/364 |
| 4,361,086 | 11/1982 | Simonotti et al. | 271/2 |
| 4,386,768 | 6/1983 | Zugel | 270/53 |
| 4,435,243 | 3/1984 | Azeez et al. | 109/24.1 |
| 4,509,739 | 4/1985 | Kurokawa | 271/215 |
| 4,512,263 | 4/1985 | Lanning | 109/24.1 |
| 4,540,106 | 9/1985 | Fukatsu | 271/2 |
| 4,585,432 | 4/1986 | Marysse | 271/273 |
| 4,607,831 | 8/1986 | Raybuck | 271/240 |

FOREIGN PATENT DOCUMENTS

| | | | |
|---|---|---|---|
| 100960 | 2/1984 | European Pat. Off. . | |
| 109743 | 5/1984 | European Pat. Off. . | |
| 2628889 | 4/1977 | Fed. Rep. of Germany . | |
| 8900 | 1/1977 | Japan | 198/627 |
| 23112 | 3/1981 | Japan | 198/836 |
| 102755 | 6/1984 | Japan | 217/219 |
| 337688 | 11/1930 | United Kingdom | 198/627 |
| 763013 | 12/1956 | United Kingdom | 198/836 |
| 1373349 | 11/1974 | United Kingdom . | |
| 2119993 | 11/1983 | United Kingdom . | |

OTHER PUBLICATIONS

IBM TECHNICAL BULLETIN, vol. 27, No. 3, Aug. 1984, pp. 1433–1435, New York, U.S.; T. Hama et al.: "Bill feed-in/feed-out mechanism for bill storing box in automatic teller machine of bill circulation type".

European Search Report/EP 85 10 6600.

*Primary Examiner*—Robert P. Swiatek

*Assistant Examiner*—Cary E. Stone

*Attorney, Agent, or Firm*—Stevens, Davis, Miller & Mosher

[57] ABSTRACT

A device for accommodating cash enclosing envelopes comprising an envelope container having an inlet at an upper side portion thereof, an envelope receiving member disposed substantially horizontally within the container and guidable upward and downward, a sensor for detecting the quantity of cash enclosing envelopes placed on the receiving member, and a drive assembly for moving the receiving member upward or downward in response to a detection signal from the sensor to position the uppermost of the cash enclosing envelopes on the receiving member at a substantially definite level at all times.

7 Claims, 3 Drawing Sheets

DEVICE FOR ACCOMODATING CASH ENCLOSING ENVELOPES

This application is a continuation, of application Ser. No. 738,415, filed May 28, 1985, now abandoned.

BACKGROUND OF THE INVENTION

The present invention relates to a cash enclosing envelope accommodating device for use in an enveloped cash depositing machine which is a kind of automatic depositing machine to be installed and used in banks and other financial institutions and in which bills, valuable securities, cards or the like as enclosed in envelopes are processed for depositing. The term "cash enclosing envelope" as herein used and in the appended claims refers to an envelope which has enclosed therein bills, valuable securities, cards or the like having some value imparted thereto and which is used for depositing the contents.

Devices for accommodating cash enclosing envelopes comprises an envelope container which has an envelope inlet at an upper side portion thereof. Such accommodating devices heretofore known are merely so adapted that the cash enclosing envelope placed in through the inlet of the container is allowed to fall under gravity and thereby be accommodated in the container. Accordingly a large number of cash containing envelopes are accumulated in the container in a random and unstable fashion to result in the problem of inefficient accommodation. Moreover, withdrawal of the envelopes from the container requires some labor, while an objectionable force will act on envelopes to possibly break an envelope.

SUMMARY OF THE INVENTION

The main object of the present invention is to provide an envelope accommodating device by which cash enclosing envelopes can be stacked up in an orderly manner within a container and which assures an improved accommodation efficiency and ease of handling.

The device of the invention for accommodating cash enclosing envelopes comprises an envelope container having an inlet at an upper side portion thereof, an envelope receiving member disposed substantially horizontally within the container and guidable upward and downward, means for detecting the quantity of cash enclosing envelopes placed on the receiving member, and drive means for moving the receiving member upward or downward in response to a detection signal from the detecting means to position the uppermost one of the cash enclosing envelopes on the receiving member at a substantially definite level at all times.

Within the envelope accommodating device, the receiving member is controlled to move upward or downward so that the uppermost one of the cash enclosing envelopes on the receiving member is at a substantially definite level at all times. Accordingly, the cash enclosing envelope taken into the container through its inlet is allowed to fall under gravity a substantially constant distance at all times, and this distance of fall can be set to a very small value, with the result that the cash enclosing envelopes placed onto the receiving member one after another can be stacked up thereon in an orderly arrangement. This results in an improved accommodation efficiency, eliminates the likelihood that the cash enclosing envelope will be subjected to an objectionable force that could cause damage to the envelope, and further renders the envelopes easy to handle when they are to be withdrawn from the container.

DESCRIPTION OF THE PREFERRED EMBODIMENT

The illustrated embodiment of the invention is adapted for use in an enveloped cash depositing machine.

Figure 1:
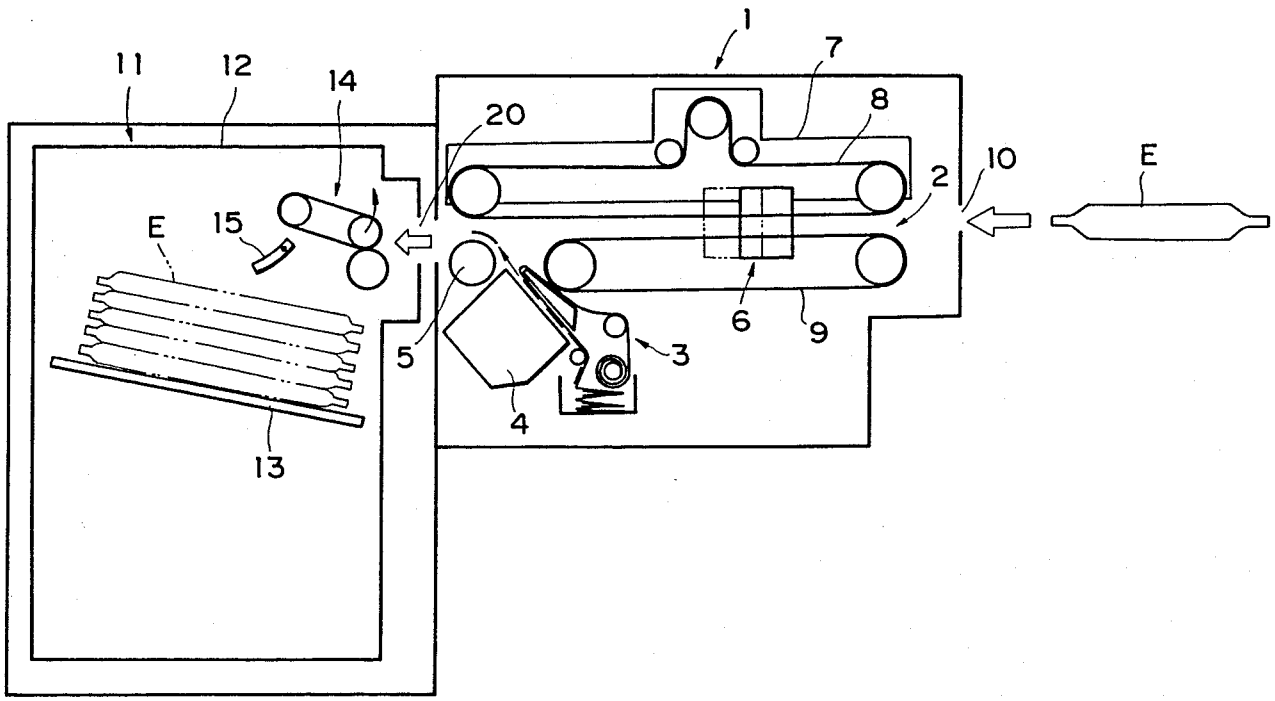
FIG. 1 schematically shows the construction of an enveloped cash depositing machine.

With reference to FIG. 1, the depositing machine comprises an envelope handling device 1 for marking a cash enclosing envelope E with receipt data when the envelope E is placed into the device 1 through an inlet 10, and an envelope accommodating device 11 for accommodating the envelope E processed for receipt.

The envelope handling device 1 comprises a conveyor 2 for transporting the envelope E placed in through the inlet 10 to the accommodating device 11, a printer 4 for printing on the surface of a label receipt data as to the envelope E placed in, a label feeder 3 for supplying to the path of transport of the conveyor 2 labels each having receipt data printed on one surface and an adhesive applied to the other surface, posture adjusting means 6 for aligning the envelope being transported with the path of transport and directing the envelope toward the direction of transport, and a roller 5 for affixing the label to the lower surface of the forwarded envelope. The labeled envelope is sent to the accommodating device 11. The conveyor 2 comprises an upper belt 8 and a lower belt 9 for transporting the envelope as held therebetween. The upper belt 8 is provided on a support assembly 7 which is supported upwardly or downwardly movably. The label and the envelope are brought into pressing contact with each other between the upper belt 8 and the roller 5, whereby the label is affixed to the lower surface of the envelope.

The envelope accommodating device 11 comprises a container 12 for cash enclosing envelopes. The container 12 has an inlet 20 formed at an upper portion on its one side and opposed to the outlet of the envelope handling device 1. Provided inside the container 12 is a receiving plate 13 which is slightly inclined downward toward the inlet 20. The plate 13 is guided upward and downward. Lift drive means moves the plate 13 upward or downward. An assembly 14 for taking in the envelope sent into the inlet 20 is disposed within the container 12 near the inlet 20. A sensor lever 15 is pivotably provided above the receiving plate 13. When the uppermost one of cash enclosing envelopes E on the receiving plate 13 pushes up one end of the sensor lever 15 in contact therewith, the receiving plate 13 is lowered by the lift drive means to a position where the uppermost envelope tends to move out of contact with the sensor lever 15. In this way, the level of the receiving plate 13 is so adjusted that the uppermost of the cash enclosing envelopes on the receiving plate 13 will be held at a substantially definite level at all times.

Figure 2:
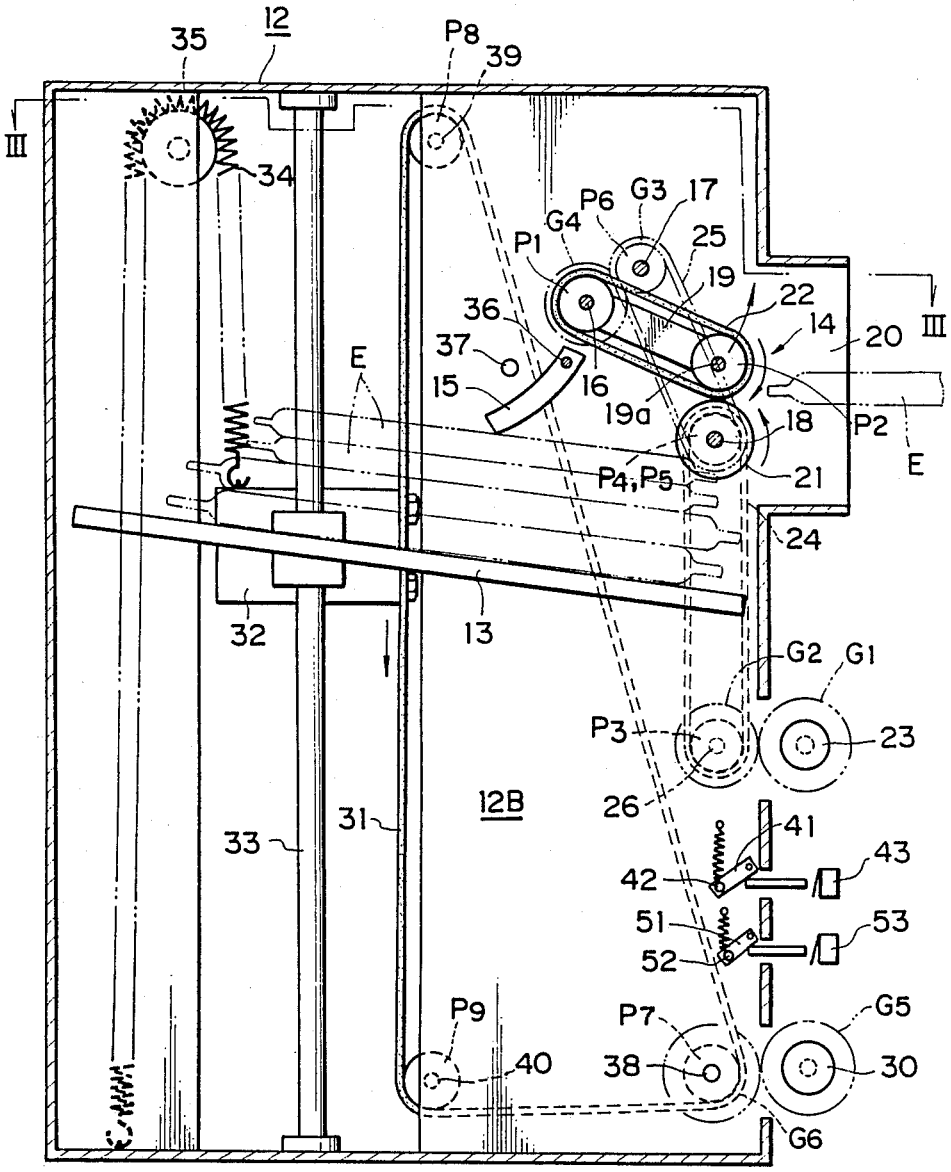
FIG. 2 is a view in section taken along the line II—II in FIG. 3 and showing a cash enclosing envelope accommodating device.
Figure 3:
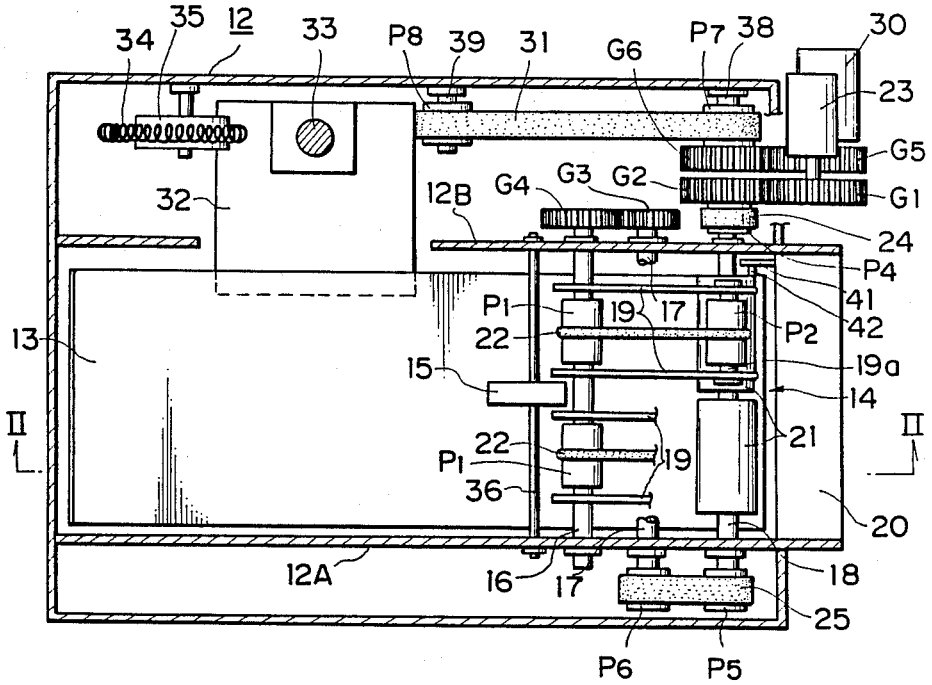
FIG. 3 is a view in section taken along the line III—III in FIG. 2 and showing the same.

FIGS. 2 and 3 show the envelope accommodating device 11 in greater detail.

The container 12 is internally provided with partitions 12A and 12B for defining a space for accommodating envelopes. The envelope taking-in assembly 14 includes rotary shafts 16, 17 and 18 rotatably supported by and extending between the partitions 12A and 12B. The rotary shaft 16 has two pulleys P1 and a pair of pivotal plates 19 disposed on opposite sides of each pulley P1 and each pivotably attached at its one end to the shaft 16. A rotary shaft 19a is provided between the other ends of the pair of pivotal plates 19 and carries a pulley P2. An endless belt 22 is reeved around the pulleys P1 and P2. Two rollers 21 are fixedly mounted on the rotary shaft 18. The pulleys P2 supported by the pivotal plates 19 bear on the rollers 21.

A taking-in drive motor 23 is attached to a lower portion of the container 12 outside thereof and has an output shaft carrying a spur gear G1. A rotary shaft 26 mounted on a lower portion of the partition 12B and projecting outside the envelope accommodating space is provided with a pulley P3 and a spur gear G2. The spur gears G1 and G2 are in mesh with each other. The rotary shaft 18 extends outward beyond the partitions 12A and 12B, and pulleys P5 and P4 are fixedly mounted on the shaft ends. A belt 24 is reeved around the pulleys P4 and P5. Opposite ends of the rotary shaft 17, similarly extending outward beyond the partitions 12A and 12B, are provided with a pulley P6 and a spur gear G3, respectively. A belt 25 is reeved around the pulleys P6 and P5. One end of the rotary shaft 16 extends outward beyond the partition 12B and fixedly carries a spur gear G4 meshing with the gear G3.

With the above arrangement, the rollers 21 and the pulleys P1 rotate in timed relation, further causing the belts 22 to rotate the pulleys P2 in timed relation with but in opposite direction to the rollers 21, whereby the envelope E placed between the pulleys P2 and the rollers 21 is taken in. Since the pivotal plates 19 are movable about the rotary shaft 16, the pulleys P2 are pushed up by the inserted envelope E by an amount corresponding to the thickness of the envelope E.

An upright post 33 is provided outside the container 12 at one side thereof and extends through a bore formed in a lift block 32, which in turn is movable on the post 33 upward and downward. A portion of the lift block 32 is projected into the envelope accommodating space through a vertically elongated cutout formed in the partition 12B, and the receiving plate 13 is fixed to the projecting portion. A tension spring 34 is secured at its one end to the lift block 32. The tension spring 34 is passed over a pulley 35 rotatably supported by an upper portion of the container 12 and extends downward. The other end of the spring 34 is fixed to the bottom of the container 12. Thus, the lift block 32 and the receiving plate 13 are biased upward.

A lift drive motor 30, mounted on a lower portion of the container 12 outside thereof, has an output shaft fixedly carrying a spur gear G5. Two lower rotary shafts 38, 40 and an upper rotary shaft 39 disposed within the container 12 outside the partition 12B are attached to a side wall of the container 12. The rotary shafts 39 and 40 are so arranged that a line through these shafts 39 and 40 is vertical. The shaft 38 fixedly carries a gear G6 meshing with the gear G5 and a pulley P7. The shafts 39 and 40 are provided with pulleys P8 and P9, respectively. A belt 31, which is preferably a timing belt, is reeved around the pulleys P7, P8 and P9. Between the pulleys P8 and P9, a portion of the belt 31 is fixed to the lift block 32.

It will be understood that the motor 30, when driven lowers the receiving plate 13 against the action of the spring 34. When required, the motor 30 is provided with a brake.

The lever 15 is arcuate, and the bulging side thereof is oriented downward or toward the inlet 20. The lever 15 is pivotably supported at its one end by a rod 36 extending between and fixed to the partitions 12A and 12B. A photosensor 37 is provided, such that the optical path thereof is blocked by the lever 15 when the other end, i.e. acting end, of the lever 15 is raised approximately to the level of the rod 36. The lever 15 and the photosensor 37 constitute means for detecting the quantity of cash enclosing envelopes on the receiving plate 13.

Every time a cash enclosing envelope E is taken into the container 12 through the inlet 20 by the taking-in assembly 14, advancing in a substantially horizontal position, the envelope pushes up the acting end of the lever 15. When the acting end of the lever 15 blocks the optical path of the photosensor 37, the motor 30 is driven to slightly lower the receiving plate 13. In the meantime, the envelope taken in is placed in the uppermost position on a stack of envelopes on the receiving plate 13. The acting end bearing on the uppermost envelope no longer blocks the optical path of the photosensor 37. Since the receiving plate 13 is thus lowered by a suitable amount and then held in place every time an envelope is taken in, the uppermost one of the envelopes on the receiving plate 13 is maintained at a substantially definite level at all times. The distance the taken-in envelope falls under gravity is so small that envelopes are orderly stacked up on the receiving plate 13. If the envelope taken in has a large thickness, the acting end of the lever 15 still remains to block the optical path of the photosensor 37 even when the receiving plate lowers slightly. Consequently, the receiving plate 13 is lowered until the optical path is no longer blocked.

As the receiving plate 13 further descends, the plate 13 strikes against a pin 42 on the free end of a lever 41 which is pivotably supported and retained in a suitable posture by a spring, pushing down the lever end against the action of the spring to cause an intermediate member to actuate a near fullness detecting switch 43. The detection signal of the switch 43 turns on a near fullness display lamp (not shown).

Disposed further below the near fullness detecting means is fullness detecting means which comprises a lever 51 having a pin 52, and a switch 53. When the receiving plate 13 is lowered to this position, a fullness detection signal is produced to turn on a fullness display lamp and given an alarm. Further in response to the fullness detection signal, shutters (not shown) provided for the inlets 10 and 20 are closed to automatically discontinue processing for cash enclosing envelopes.

When all the envelopes in the container 12 are withdrawn, the motor 30 is made free to rotate idly, and the receiving plate 13 is raised to the specified position by the action of the spring 34. Thus, the device is returned to the initial state.

What is claimed is:

1. A depositing device for handling and accommodating cash enclosing envelopes comprising:

an envelope container having an inlet at an upper side portion thereof:

an envelope receiving member disposed substantially horizontally and slightly inclined downwardly toward the inlet within the container and guidable upward and downward, means for detecting the quantity of cash enclosing envelopes placed on the receiving member, drive means for moving the receiving member upward or downward in response to a detection signal from the detecting means to position the uppermost of the cash enclosing envelopes on the receiving member at a substantially predetermined level at all times, and biasing means for biasing said receiving member upwardly to prevent said receiving member from falling down when said drive means is disengaged.

2. A device as defined in claim 1 further comprising an envelope taking-in assembly disposed in the vicinity of the inlet.

3. A device as defined in claim 2 wherein the taking-in assembly comprises upper and lower rotary members drivingly rotatable in a direction to take in cash enclosing envelopes, and the upper rotary member is supported upwardly or downwardly movably.

4. A device as in claim 2 further comprising (a) second driving means for generating a drive force, the driving means being disposed outside of the container and having a third engaging means for transmitting the drive force generated thereby, and (b) fourth engaging means, disposed inside the container and engaging with the third engaging means through a second opening formed on the side portion of the container, for receiving the drive force from the second driving means to transmit said drive force from the second driving means to the envelope taking-in assembly.

5. A device as defined in claim 1 further comprising a sensor for detecting descent of the receiving member to a specified position to produce a signal indicating that the container is almost full of cash enclosing envelopes.

6. A device as in claim 1, wherein said drive means comprises (i) a lift block supported to slide axially along a vertical shaft in said container, said receiving member being connected to said lift block, and (ii) a conveyor belt means attached to said lift block, for driving said lift block and in turn said receiving member to move upward or downward.

7. A device as in claim 1 further comprising biasing means for biasing the receiving member upwardly to prevent the receiving member from falling down when the first engaging means and the second engaging means are disengaged from each other.

* * * * *